United States Patent [19]

Whitmer

[11] 4,037,824

[45] July 26, 1977

[54] SAFETY POST

[76] Inventor: Gerald T. Whitmer, Rte. 1, Box 33, Shenandoah Junction, W. Va. 25442

[21] Appl. No.: 677,140

[22] Filed: Apr. 15, 1976

[51] Int. Cl.[2] ..... B21F 27/00

[52] U.S. Cl. ..... 256/53

[58] Field of Search ..... 403/59; 256/59, 65, 256/53; 248/226 B, 226 C; 52/754; 119/119, 120

[56] References Cited

U.S. PATENT DOCUMENTS

| | | | |
|---|---|---|---|
| 1,563,212 | 11/1925 | Madiar | 119/120 |
| 2,706,662 | 4/1955 | Brown | 256/DIG. 6 |
| 3,217,833 | 11/1965 | Smith | 182/3 |
| 3,678,903 | 7/1972 | Ferraro | 119/120 |

*Primary Examiner*—Werner H. Schroeder
*Assistant Examiner*—Doris Troutman
*Attorney, Agent, or Firm*—John F. McClellan, Sr.

[57] ABSTRACT

A safety post for construction workers and the like comprising angle structure having integral horizontal and vertical legs, the horizontal leg having a clamp including fixed and movable tapered members opposed on the underside of the horizontal leg for detachably gripping structural beams, the movable member having a portion loosely encircling the horizontal leg with a fulcrum below and screw structure operable from above to pivot and tighten the movable member; the vertical member having a column which may optionally be height-adjustable by telescoping of separate lengths, and which terminates at the top in a pair of fixed arcuate horns with the ends inward turned and overlappingly spaced for retaining a safety cable therebetween while permitting workmen to walk their safety lines along the cable without need to unsnap the safety lines at the safety post.

10 Claims, 4 Drawing Figures

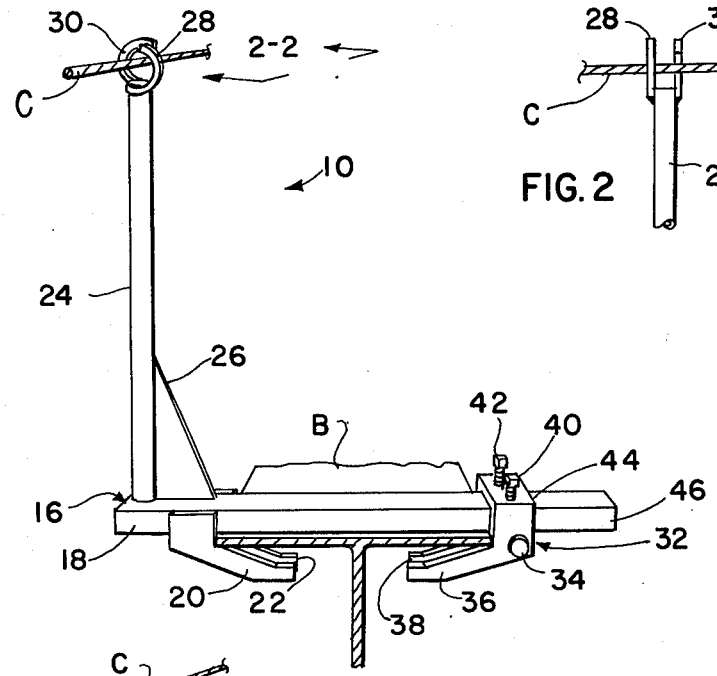
FIG. 1
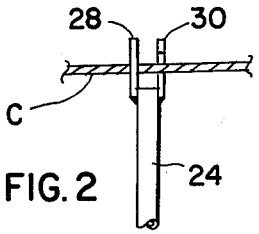
FIG. 2
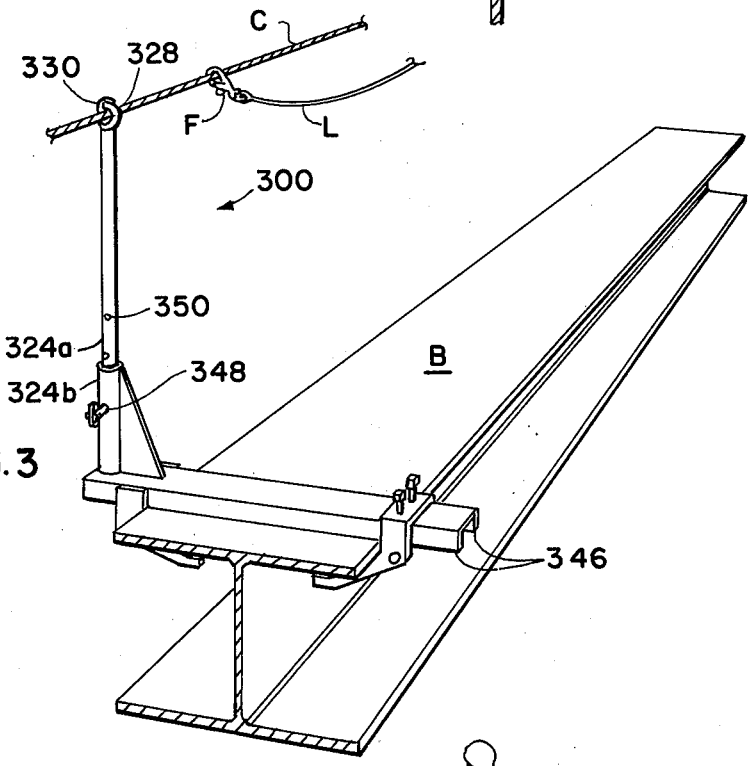
FIG. 3
FIG. 4
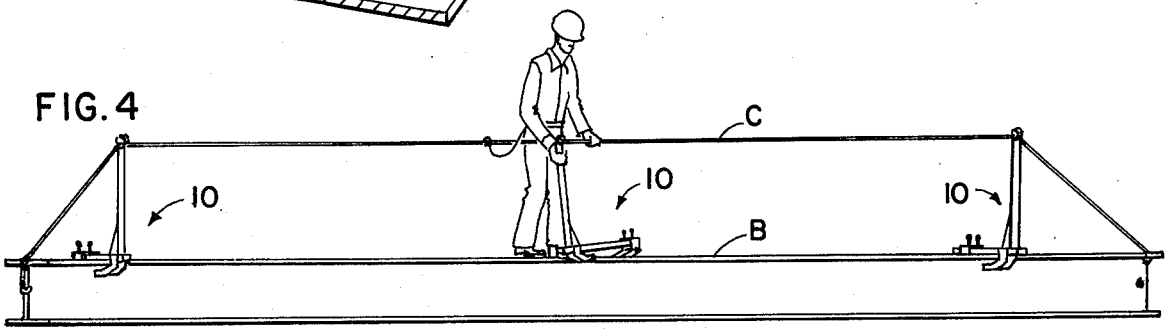

SAFETY POST

This invention relates generally to safety devices and particularly to a safety post for construction and maintenance workers.

Important objects of this invention are to provide for construction and maintenance workers a detachable safety post for engaging safety-line securing cables, which post can be erected at an intermediate point of a taut cable, positively engaging the cable without employment of relatively movable cable-engaging parts, and permitting a worker to slide his safety line fastener along the cable past the post without detaching the safety line.

Further important objects of this invention are to provide a safety post as described which provides for reliable, balanced, convenient, simple installation using only a wrench to tighten the fastening means from above and with clear access.

Still further important objects are to provide a safety post as described which places only a low, uniform obstruction in the walking path, which seats on spaced flanges and secures with spaced jaws and which tightens as the movable jaw portion is set.

And yet further of said objects are to provide a safety post as described which is non-jamming; which clamps with low stress, short coupled, direct load transfer on the mechanism; which is damage resistant, easy to inspect, and which accommodates to a wide range of beams, and safely works to wide tolerances.

And still further of said objects are to provide a safety post as described which in one embodiment is height-adjustable, which is economical to manufacture, ship, purchase and use, which employs commonly available materials simply fabricated and which is lightweight, handy and attractive in appearance.

In brief summary given for purposes of cursive description only the within disclosure provides safety post with a horizontal member having fixed and movable set-tightening jaws operable from above with clear access, and an upright having thereon fixed, offset means for engaging an intermediate portion of a cable and for permitting a safety line fitting to pass freely along the cable past the safety post.

The above and other objects and advantages of this invention will become more readily apparent on examination of the following description, including the drawings, in which like reference numerals refer to like parts:

FIG. 1 is an elevational perspective view partially in section;

FIG. 2 is a side elevational detail taken at 2—2, FIG. 1;

FIG. 3 is an isometric view, partly in section; and

FIG. 4 is an elevational perspective view.

FIG. 1 shows the invention 10 in use, mounted on a structural beam B and engaging a worker's safety-line cable C.

The invention includes an angle-shaped integral frame 16 having a channel-section horizontal leg 18, to which a set of fixed jaws 20, 22 is welded in parallel adjacent a first end and from which at that end a tubular vertical or upright leg 24 rises, supported by a gusset 26. The gusset extends no farther along the horizontal leg than the upper portion of the fixed jaws, and thus helps define but does not protrude into the safe walking area on the horizontal leg, or area contiguous with a beam clamped by it.

The upper end of the vertical leg terminates in a pair of inwardly turned arcuate horns 28, 30. In face view the horns overlap at the top, forming a "ring" shape, but, as will be seen in the next Figure, in side view the horns are spaced apart, being welded on diametrically opposite surfaces of the upright leg.

Between them the horns retain the safety-line cable, which passes through the "ring" shape they form in face view.

Clamping the frame to the beam in coaction with the fixed jaw set is accomplished by means of movable jaw set 32 facing the fixed jaw set and comprising a squared "A" bent plate shape in end view with the crosspiece being a cylindrical steel rod 34 connecting the arms of the "A" at an intermediate position providing loose sliding fit when the horizontal leg is inserted in the space above the rod.

In side view the rod, which preferably passes completely through holes in the jaw set and is welded at both ends, is offset in the piece outboard or away from the arm extension or paired, parallel terminal jaw-portions. The terminal jaw-portions 36, 38 extend inwardly and downwardly forming an open angle for receiving the flange of a beam, in complementary manner to the fixed jaws on the other end of the horizontal leg.

One machine screw may be used to set the movable jaw in place, but preferably two machine screws are used for greater safety and less flexure of the parts assembled. The screws 40, 42 pass downward through the upper crosspiece 44 of the movable jaw set in tapped holes laterally spaced from each other sufficiently so that the screws bear on the sides of the base of the horizontal leg in line with the horizontal leg flanges 46.

In side view the set screw axes do not align with the cylindrical steel rod, but instead are displaced in location toward the terminal portions of the jaws.

In operation, this displacement causes upward pivoting of the movable jaws about the steel rod as a fulcrum when the screws set the position of the movable jaws, pivotally tightening the movable jaw set against the flange. When the screws are loosened again the movable jaw set pivots back, loosening the attachment to both the beam and the horizontal leg, preventing jamming. The movable jaw set upper portion rises directly upward from the remainder and this stops it short of protruding into the previously mentioned safe walking area regardless of whether tightened by the screws or loose, and helps it define the safe walking area.

FIG. 2 better shows in side view detail taken at 2—2, FIG. 1 the generally parallel spacing between the respective inward turned arcuate horns 28, 30, which are proportioned to provide clearance around the cable when threaded through the "ring" shape as shown. It is necessary for reasons to be discussed that the generally parallel spacing is sufficiently great to pass the cable freely through the spacing.

FIG. 3 shows a second embodiment 300 of the invention installed on a beam. In this embodiment, the upright arm has upper and lower telescoping parts **324*a*, 324*b*, the upper part being received slidably in the lower and secured adjustably in height by a pin 348 passing through holes in the lower part and matching adjustment holes of a series 350** in the upper part.

Not only does this feature provide means of height adjustment but it provides for exceptionally easy installation of the safety post. With the upper part set low, the safety post is clamped to the beam, then the pin is withdrawn, the upper part is telescoped upward, rotated to snare the safety cable, and then is pinned at the correct height.

Also shown is a workman's safety leader, or line L secured by a fitting F to cable C which passes through and is retained by the horns 328, 330. When the workman walks along the beam he does not have to disconnect his safety cable at the posts, but instead merely rotates the fitting over and back as he passes the post, threading it past the horns, and continues on his way.

Also more clearly visible in this view are the flanges 346 of the horizontal leg channel, giving wide spread non-teetering, stable bearing on the top of the flange even though local irregularities might protrude upward from the beam between the flanges. Similarly, the two-screw clamping tends to regulate the angle of the movable set of jaws so that both jaws of the set grip the flange, further stabilizing the safety post. Even if one jaw on a side should be broken, bent or loosened by accident, the unit would still remain safely in place. From the Figures it can also be seen that various flange widths and thickness in the range of ¼ in. (6mm) to 3 inches (75 mm) are easily accommodated, and even thin decks can be gripped.

FIG. 4 illustrates a workman preparing to install the non-telescoping embodiment 10. After the cable C is supported at the ends, he simply carries a safety post to any desired intermediate position and angles it, engaging the cable, then hooks the safety post fixed-jaw set under the beam flange, after which he pulls the movable jaw set into contact with the flange and tightens the set screws. Removal is as simple, the end posts coming down last.

Material for this invention can be mild steel throughout, assembled generally by welding.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is desired to be secured and protected by U.S. Letters Patent is:

1. A post for detachable affixation on flanged beams and the like to support a workers' safety-line-securing cable, comprising: a horizontal leg, a vertical leg, means for joining all said legs, means for clamping the horizontal leg to a said flanged beam, and the vertical leg having fixed thereto means including inwardly-turned overlapping horn structure having spacing for detachably engaging an intermediate portion of a said cable upon rotation thereof relative to a said cable, said spacing being proportioned for permitting a said workers' safety line on a said cable to be rotated in said spacing and passed along a said cable for passing a said post.

2. A post as recited in claim 1, the means for clamping including respectively fixed and movable jaw portions below the horizontal leg downwardly and inwardly sloping facing relation, the movable jaw portion having a first part with fastening means therein above the horizontal leg and a second part transversely below the horizontal leg and offset outboard of the fastening means for pivoting and tightening the movable jaw portion upon actuation of the fastening means.

3. A post as recited in claim 2, the vertical leg having upper and lower telescoping portions, and releasible means for adjustably securing together all said telescoping portions.

4. A post as recited in claim 2, the horizontal leg comprising a member having a downward flange along each side thereof, the fastening means including structure defining at least one tapped hole in said first part over a said downward flange, and a set screw in the at least one tapped hole for tightening against the horizontal leg.

5. A post as recited in claim 2, the movable jaw portion having a pair of parallel spaced jaws, and said second part comprising a rod connecting the pair of parallel spaced jaws.

6. A post as recited in claim 5, the fixed jaw portion comprising a pair of parallel spaced jaws.

7. A post as recited in claim 6, and a gusset connecting the horizontal arm and the vertical arm, the gusset extending along the horizontal leg no further than the upper part of the fixed jaw portion.

8. A post as recited in claim 5, , the horizontal leg comprising a channel with a pair of spaced flanges downwardly extending along respective sides thereof, the fastening means including structure defining a respective tapped hole in said first part over each said flange, and a respective set screw in each tapped hole.

9. A post as recited in claim 5, the movable jaw portion first part extending vertically upwardly therefrom, whereby said first part is prevented from protruding inboard when the movable jaw portion is clamping a said flanged beam.

10. A post for detachable affixation on flanged beams and the like to support a worker's safety-line-securing cable, comprising: a horizontal leg, a vertical leg, means for joining all said legs, means for clamping the horizontal leg to a said flanged beam including respectively fixed and movable jaw portions below the horizontal leg in downwardly and inwardly protrusive facing relation, the movable jaw portion having a first part with fastening means therein above the horizontal leg and a second part transversely below the horizontal leg and offset outboard of the fastening means for pivoting and tightening the movable jaw portion upon actuation of the fastening means, and the vertical leg having means for engaging a said cable.

* * * * *